US008827121B2

(12) United States Patent
Law et al.

(10) Patent No.: US 8,827,121 B2
(45) Date of Patent: Sep. 9, 2014

(54) DISPENSER PUMPS

(75) Inventors: Brian Robert Law, Leicester (GB); David John Pritchett, Ashby de la Zouch (GB)

(73) Assignee: Rieke Corporation, Auburn, IN (US)

( * ) Notice: Subject to any disclaimer, the term of this patent is extended or adjusted under 35 U.S.C. 154(b) by 255 days.

(21) Appl. No.: 12/951,098

(22) Filed: Nov. 22, 2010

(65) Prior Publication Data

US 2011/0174840 A1 Jul. 21, 2011

(30) Foreign Application Priority Data

Nov. 26, 2009 (GB) ..... 0920768.9

(51) Int. Cl.
*B65D 88/54* (2006.01)

(52) U.S. Cl.
USPC ..... 222/321.9; 222/481.5; 222/384; 222/321.7; 222/320; 222/153.13

(58) Field of Classification Search
USPC ..... 222/327, 153.06, 153.13, 384, 546, 222/340, 341, 320–321.9; 210/120
See application file for complete search history.

(56) References Cited

U.S. PATENT DOCUMENTS 3,391,647 A * 7/1968 Corsette et al. ..... 417/456
4,299,238 A * 11/1981 Baidwan et al. ..... 600/576
4,369,899 A * 1/1983 Magers et al. ..... 222/153.13
4,410,107 A * 10/1983 Corsette ..... 222/321.7
4,479,589 A * 10/1984 Ford ..... 222/153.13
5,171,439 A * 12/1992 Vakharia ..... 383/100
5,335,830 A * 8/1994 Cater ..... 222/153.13
5,405,057 A * 4/1995 Moore ..... 222/153.14
5,720,419 A * 2/1998 Li ..... 222/321.2
5,738,250 A * 4/1998 Gillingham et al. ..... 222/153.13
6,006,949 A * 12/1999 Foster et al. ..... 222/153.13
6,045,008 A * 4/2000 Gonzalez Fernandez et al. ..... 222/153.13
6,053,371 A * 4/2000 Durliat et al. ..... 222/321.9
6,173,863 B1 * 1/2001 Brozell et al. ..... 222/1
6,598,766 B1 * 7/2003 Brugner ..... 222/326
7,128,246 B2 * 10/2006 Raia et al. ..... 222/327
7,735,692 B2 * 6/2010 Nelson ..... 222/190
7,874,464 B2 * 1/2011 Prague et al. ..... 222/327
2010/0006604 A1 1/2010 Ding

FOREIGN PATENT DOCUMENTS

EP 0 487 412 A1 5/1992
WO WO 2008/101368 A1 8/2008
WO WO 2008/146319 A2 12/2008
WO WO 2009/050978 A1 4/2009

OTHER PUBLICATIONS

Search Report dated Apr. 8, 2011 from EP 10251972.5, 6 pgs.

* cited by examiner

*Primary Examiner* — Frederick C Nicolas
*Assistant Examiner* — Bob Zadeh
(74) *Attorney, Agent, or Firm* — Woodard Emhardt Moriarty McNett & Henry LLP

(57) ABSTRACT

A dispenser pump is disclosed of the moveable-nozzle type, arranged for sealing a vent path in the extended position of the pump plunger. A pump body includes an internal collar formed at the lower end of a tubular insert, through which the vent path passes. This collar has a seal portion. The plunger has a complementary seal portion which makes a guided and fitting engagement with the collar seal portion. One or both of the plunger seal portion and the collar seal portion is formed as an annular taper, so that the seal portions are guided into close engagement with one another. Plunger lock-down formations are constructed to engage at the bottom of the body insert and remain below the top opening of the body.

35 Claims, 9 Drawing Sheets

DISPENSER PUMPS

CROSS REFERENCES TO RELATED APPLICATIONS

This application claims priority to Great Britain Patent Application No. GB 0920768.9, filed Nov. 26, 2009, which reference is expressly incorporated by reference herein, in its entirety.

BACKGROUND OF THE INVENTION

This invention relates to dispenser pumps of the kind in which a pump chamber is defined between a piston and a cylinder, and in which in use liquid product enters the pump chamber through a valved inlet and leaves it through an outlet, optionally valved, leading to a discharge opening.

Pumps of the kind described are well known for use in small hand-operated dispensers where the pump is mounted on a container of a liquid product to be dispensed. Usually a pump body comprising the cylinder is a fixed component, which may be mounted in a neck of the container by means of a closure or securing cap. The piston is on the inner end of a plunger whose outer manually-engageable end projects from an opening in the body, and which is reciprocable in a pumping stroke to alter the volume of the pump chamber. The usual disposition, whether at rest or in operation, has the plunger projecting upwardly from the top of the pump body and the pump chamber inlet at the bottom of the pump body, drawing product by suction from the supply container interior beneath. So, for convenience of description herein, the expressions "top", "upper" etc. are used to refer to positions and directions towards the direction of projection or extension of the plunger, although this particular orientation is not essential in practice, and the expressions "bottom", "downwards" etc. are used analogously.

Usually the pump body comprises a generally cylindrical portion constituting the cylinder in which the piston moves. The pump components are typically of molded plastics materials. A pump spring is usually provided to urge the plunger towards its extended position, thereby automatically re-filling (priming) the pump chamber with product to be dispensed after each dispensing stroke. Most hand-operated dispensers are of the "moveable nozzle" type in which the outlet, outlet channel and discharge opening are in the plunger component. However some are of the "fixed nozzle" type in which the outlet from the pump chamber, like the inlet, is part of the pump body so that the discharge channel and discharge opening need not move when the plunger is operated. The present proposals are generally applicable to pump dispensers of the kinds described above.

In pump dispensers of the kinds described it is necessary to vent exterior air into the container to compensate for the volume of product dispensed, unless a collapsible container is used. Usually this venting is provided in the structure of the pump, so that the simplest possible standard containers can be used. One type of vent path admits air at an exterior vent opening of the pump body, typically at or adjacent to the point of emergence of the stem from the pump body, into a clearance between the stem and pump body/cylinder wall which is above the piston, i.e. outside the pump chamber, and then to one or more restricted vent openings out through (or around a top edge of) the cylinder wall to the container interior.

Typically the vent opening is provided by one or more small holes or slots through an upper region of the cylinder wall. A narrow and tortuous vent path is usually desirable because the compensation air need not enter quickly nor in large volume, whereas conversely it is important to avoid liquid product from escaping through the vent path if the dispenser is shaken or temporarily inverted.

It is also well known for dispensers of the kind described to have means for locking the plunger in its depressed/retracted position relative to the body (against the urging of the pump spring, where present) to make it compact for storage, shipping and display. Such dispensers are usually called "down-shippers". Respective lock-down formations are provided on the plunger and pump body whereby when depressed the plunger can be turned to bring the formations into engagement and lock it down. Suitable lock-down formations include circumferentially-localized slots on one component through which a lug on the other component can pass and then be turned out of register with the slot, or cam formations such as partial or complete screw threads. Where the vent path passes between a plunger stem and a collar of the pump body, it can be arranged that part of the plunger blocks or plugs the corresponding clearance between stem and collar in the locked-down position, to prevent escape of liquid via the vent path e.g. during shipping.

One aspect of the present invention relates to sealing of the vent path in the extended position of the plunger. The vent path extends through a vent gap defined between the plunger stem and a collar portion of the pump body. Each of the plunger stem and the collar has a respective seal portion. They can be complementarily shaped. In the extended position of the plunger, the stem seal portion and the collar seal portion meet and seal against one another to block the vent path. Usually, this engagement also acts as a stop engagement which limits the movement of the plunger, i.e. defines the extended position.

Preferably at least one of the stem seal portion and the collar seal portion has a tapered shape whereby the portions are guided into a closely-fitting engagement. Preferably an edge of one seal portion meets a taper surface on the other. However, it is also possible to have taper surfaces on both, e.g. complementary tapers.

Additionally or alternatively one of the stem seal portion and the collar seal portion may comprise a flexible lip portion, or even a discrete resilient seal element, e.g. of elastomer. Or, the two seal portions may make a sliding plug fit, optionally with a guide taper to lead them together.

Most dispensers have a generally cylindrical symmetry with an axis of symmetry, and in this context the above-mentioned formations may all be annular around the axis, e.g. with substantially conically-tapering downward divergence of the stem and/or collar.

The piston is usually provided as a radial enlargement at the lower end of the plunger stem. The position of the stem seal relative to the plunger is selected in dependence on the position of the corresponding body collar through which the stem operates. It may be at a position spaced above the top surface of the piston. Or, it may be at a transition from the stem to the piston.

While it is preferred that the seal be provided on the stem, an alternative possibility is to provide a seal, to block the vent path in the manner described, on top of or at the top periphery of the piston part of the plunger, and engaging upwardly or inwardly against a correspondingly downwardly- or outwardly-directed pump body component, where the sealing between these components will block the vent path. Thus, the present proposals encompass a "plunger seal" in addition to the specific "stem seal" first described above. As mentioned, the position of transition between the stem and piston is a good location for the seal.

The up-position seal described above provides the following potential benefits, taking into account that once the dispenser starts to be used, it is conventionally left standing with its plunger spring-urged to the extended position rather than being locked down again. Should the dispenser (container and pump) be knocked over or dropped in this position, conventional dispensers are liable to leakage of product through the vent channels. This is particularly relevant when the liquid product contains volatile components, such as alcohol-based liquids for infection control. With their low surface tension and high vapor pressure, these liquids leak easily. They also tend to evaporate at room temperature, and sealing of the vent in the manner described can help to prevent loss of the volatile component and thereby maintain the intended product composition and flow properties.

Known dispensers often rely on the abutment of an upward shoulder on the plunger stem or piston against a downward formation of the pump body or collar as a stop for limiting the plunger extension stroke, but these have not constituted vent seals. Firstly, not all of these pumps have the vent path running through the corresponding clearance. Secondly, a stop engagement is conventionally provided by the meeting of generally axially-directed flat annular surfaces which, because of manufacturing tolerances, cannot provide a seal. However by adapting the respective engaging portions, e.g. as described above, a good sealing effect can be achieved without having to improve the manufacturing tolerances.

Another route for unintended escape of material is through the outlet passage from the pump chamber, which is re-filled with product after each dispensing stroke. We therefore prefer to use an outlet valve in which the valve member is resiliently urged against its seat by a valve spring. For example, a ball valve and a helical spring may be used. The combination of anti-leakage measures provides a valuable improvement.

While sealing of the vent path provides valuable inhibition of product leakage and evaporative loss, there are situations in which a full or absolute seal may be problematic. For example, if the product has a volatile component e.g. an alcohol, and is subjected to a rapid temperature increase, there could be a dangerous build-up of pressure even in the plunger-up condition. It would be desirable to relieve this via the vent path rather than via the outlet valve, since the latter route would cause some ejection of liquid product. The sealing surface adaptations mentioned above enable a close fit to be obtained. It therefore becomes practical, in a variant or refinement structure, to provide for a controlled degree of limited venting by means of one or more local slots or grooves in the surfaces of one or both of the stem seal portion and the collar seal portion mentioned above. A taper feature enables the components to be guided into close surface-to-surface engagement, so that the predetermined cross-section of the slot or groove is reliably defined as the available vent area. Being narrow and small, this provides for gradual release of gas pressure in high pressure situations, while still inhibiting evaporative loss under normal conditions, but resisting the passage of liquid product because of the high energy needed to overcome the viscous resistance and surface wetting which would be entailed in a liquid leakage flow.

The number and dimensions of such gas escape vents (slots or grooves) will be determined primarily with reference to the properties of the liquid product involved and the conditions in which the container is to be used.

The above features relate to the plunger-up condition. For a down-shipper pump, it is also desirable to provide a vent path seal for the locked-down (shipping) position of the plunger. It may be provided by a downwardly-directed shoulder or divergence or other sealing element on the plunger stem or at the plunger head, which seals against a corresponding upwardly-directed sealing feature of the pump body, perhaps, the same collar as used to make the up-position seal, when the plunger is locked down. It may use any of a tapered fit, plug fit or flexible lip (on either component), e.g. as described for the up-position seal.

In all aspects herein, the preferred pump is of the moveable-nozzle type, in which the plunger contains the discharge channel. Typically the plunger has a head with a laterally-projecting spout. As is known, the outlet valve can be positioned anywhere along the discharge channel from the opening at the piston to the discharge opening of the spout. When an outlet valve spring is used, as preferred, a convenient position for the outlet valve is in the head of the plunger adjacent an angled join between stem and spout portions thereof.

A pump spring, such as a conventional metal helical spring, is desirably provided to urge the plunger towards the extended (up) position. The spring may be in the pump chamber as is conventional, bearing down against the pump chamber floor and up against the piston end of the plunger stem. Or, if it is desired to avoid contact of a metal spring component with the product to be dispensed, the spring may instead be positioned outside (above) the pump chamber, acting between a lower abutment provided in the pump body at an intermediate height, and an upper abutment close beneath the plunger head.

A second aspect of the present invention, preferably combined with the other proposals but also of independent value, relates to dispenser pumps of the kind described in which the plunger can be locked down. Conventionally, the pump body lock-down formations are at or adjacent the point of emergence of the plunger stem, the plunger lock-down formations being on the immediate underside of the plunger head. What we propose here instead is to recess the lock-down engagement into the interior of the pump body. The lock-down formation of the stem is spaced below the head thereof, and at the extended position of the plunger does not emerge beyond the plunger body. A corresponding lock-down formation(s) of the body is provided at a position recessed down inside the body, to be engaged by the stem lock-down formation in the plunger-down position.

Thus, all the portion of stem that passes through the top body opening may be of generally uniform external cross-section. A seal or wiper member may thus be provided at the top of the body around this opening to act against the outer surface of the plunger stem. This top outer seal helps to keep the interior of the pump clean and free of grit entering from outside, while also helping to prevent product or vapor leakage from the interior. If, as is preferred, this top outer seal is used in combination with other features proposed herein, it acts in combination with them.

When such a top outer seal is present, the point of emergence of the stem from the body may be unsuitable as an entrance to the vent path. If so, one or more separate vent entrances may be formed through the top of the pump body, e.g. between the top outer seal element and the top of the pump body, and through into the vent path below the engagement of the top outer seal against the plunger stem.

The pump body lock-down formation(s) may be provided integrally on the interior of a cylinder body member which also provides the pump chamber-defining cylinder, or on a discrete component such as an insert housing such as described below. Preferred lock-down formations comprise cam formations, e.g. screw thread-type formations, because they can be progressively tightened to assure a locked-down seal.

A further independent aspect of the present invention, which again is advantageously combined with one or more or all of the other proposals herein, is a discrete insert housing which is part of the pump body. The pump body comprises a cylinder body member defining the pump cylinder at a lower portion thereof, i.e. the cylinder swept by the piston. The insert housing occupies an upper portion of the cylinder body member, and is a generally tubular component projecting down inside the body member. It has a generally cylindrical side wall and a floor with a central opening through which the plunger stem passes. Preferably it plugs or fits into the top of the cylinder body member from above, being secured usually by a snap or threaded union to the latter. At its lower end it may provide any one or more of

- a support for the lower end of the pump spring,
- a pump body lock-down formation,
- a collar having a seal portion engageable with a corresponding stem seal portion to effect an up-position vent seal in accordance with the first proposal above,
- a collar seal portion for engagement with a corresponding stem seal portion for a down-position vent seal as discussed above.

For the function of vent definition and vent sealing, the insert housing wall should be a fully closed structure. Usually the vent opening through the cylinder body member wall is adjacent to the top thereof, and the insert housing extends down below it, so vent clearance or a vent path is defined between the outside of the insert housing and the inside of the body member wall. This clearance may be by means of a localised notch or groove in one or both components, but more preferably is a full annular clearance resulting from a difference in circular diameters.

A floor of the insert housing can provide a said collar for sealing or seal support at its inner periphery surrounding the stem. It may also provide a seat for the bottom end of the pump spring. A lock-down formation, such as one or more screw thread portions or one or more other cam or lug elements, may be provided as a radially inward projection(s) on the side wall of the insert housing.

In a preferred embodiment the plunger stem comprises a central stem tube inside a helical plunger spring, passing through the collar opening in the insert housing floor, and an outer skirt having the plunger lock-down formations at its lower extremity, with the spring extending in a radial clearance between the stem tube and the outer skirt.

Other features of the dispenser and pump may be conventional. For example, feed to the pump chamber may be through a conventional dip tube or other inlet, via a ball valve or other conventional inlet valve. The front of the piston may be designed to plug or block the pump chamber inlet opening in the lock-down position. The pump components may be held on the container by a retaining cap, e.g. a snap or threaded cap, having a central opening surrounded by an inward retaining flange. An outward flange around the top of the pump cylinder body member can be trapped down onto the top edge of the container neck by the retaining cap.

The pump and container may be made from conventional materials, or from special materials selected in accordance with the skilled person's knowledge when special technical needs arise.

BRIEF SUMMARY

The application discloses dispenser pumps, preferably of the moveable-nozzle type, with means for sealing a vent path in the extended position of the pump plunger. The pump body includes an internal collar formed at the lower end of a tubular insert, through which the vent path passes. This collar has an annular seal portion. The plunger has a complementary seal portion which makes a guided and fitting engagement with the pump body collar seal portion when the plunger reaches its extended position relative to the body. One or both of the plunger seal portion and the body collar seal portion is formed as an annular taper, so that the seal portions are guided reliably into close engagement with one another without fine manufacturing tolerances being required. Plunger lock-down formations may be formed to engage at the bottom of the body insert as mentioned, so that they remain below the top opening of the body and the latter can be provided with a seal at its top opening to act against the plunger stem and keep the interior of the pump mechanism clean.

One object of the present disclosure is to describe an improved dispenser pump.

BRIEF DESCRIPTION OF THE SEVERAL VIEWS OF THE DRAWINGS

Dispenser pumps embodying these proposals are now described with reference to the attached drawings, in which.

DETAILED DESCRIPTION

Figure 1:
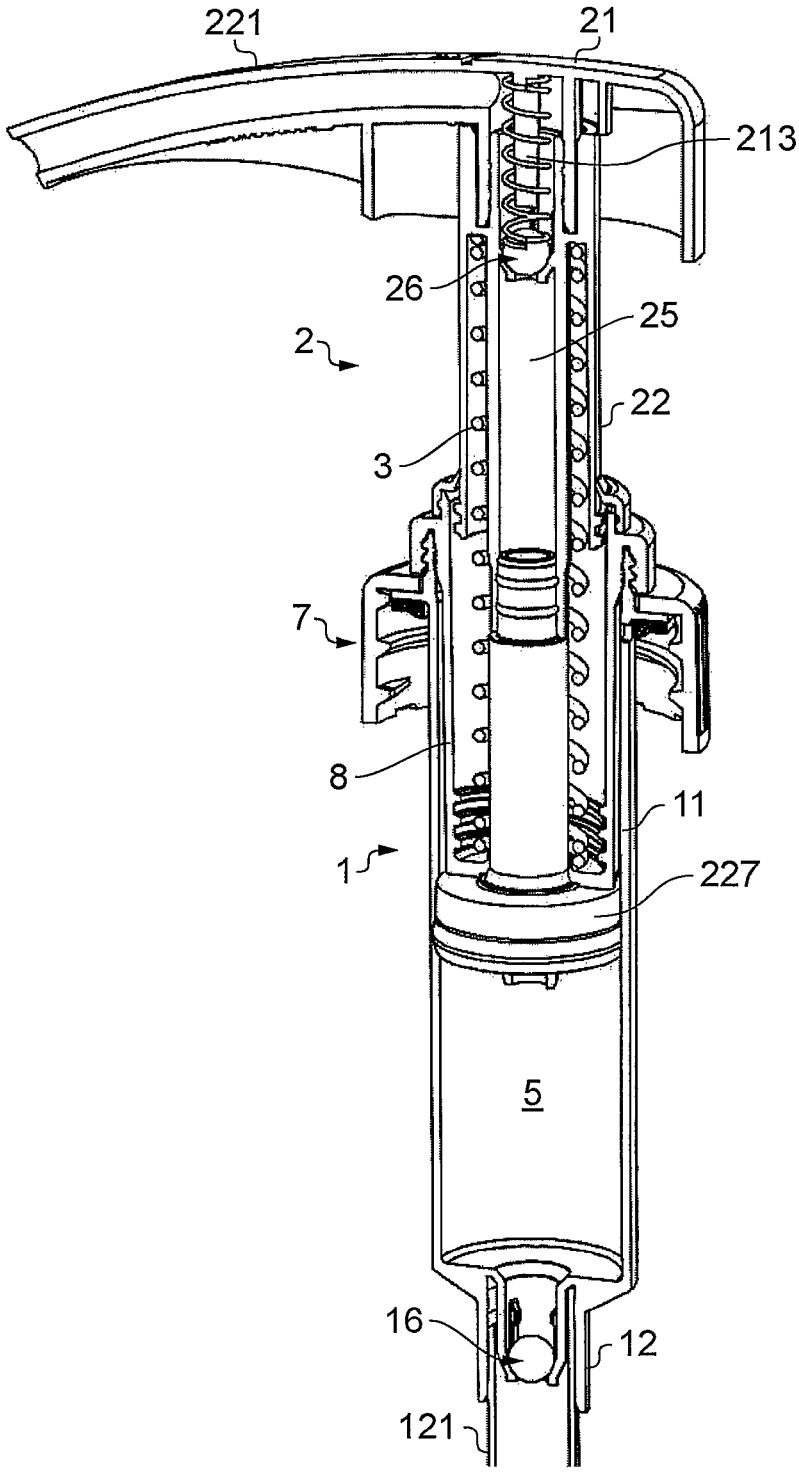
FIG. 1 is a partial perspective view, in full section, of a dispenser pump according to the present disclosure.

For the purposes of promoting an understanding of the disclosure, reference will now be made to the embodiments illustrated in the drawings and specific language will be used to describe the same. It will nevertheless be understood that no limitation of the scope of the disclosure is thereby intended, such alterations and further modifications in the illustrated device and its use, and such further applications of the principles of the disclosure as illustrated therein being contemplated as would normally occur to one skilled in the art to which the disclosure relates.

Referring initially to FIG. 1, a dispenser pump embodying the invention has a pump body 1 consisting essentially of a main cylinder member 11 and a collar insert or insert housing 8 fitted into its top, and a plunger 2 having a stem 22 carrying at its bottom end a piston 227 which is slidable in the lower part of the cylinder member 11, beneath the collar insert 8, to define a pump chamber 5. A retainer cap 7 holds the pump body 1 mounted inside the neck of a container (not shown). The cylinder member 11 is generally cylindrical in form, having at its lower end an inlet 12 with an inlet valve 16, here a ball valve, and mounting a dip tube 121. These may be conventional.

The pump is a moveable-nozzle dispenser, the stem 22 of the plunger 2 being tubular and defining a discharge passage 25 leading up to a head 21 of the dispenser and out along a nozzle 221. An outlet valve 26 is provided in the outlet passage. This embodiment uses a ball valve immediately below the plunger head 21. Other types of outlet valves may be used.

Figure 2:
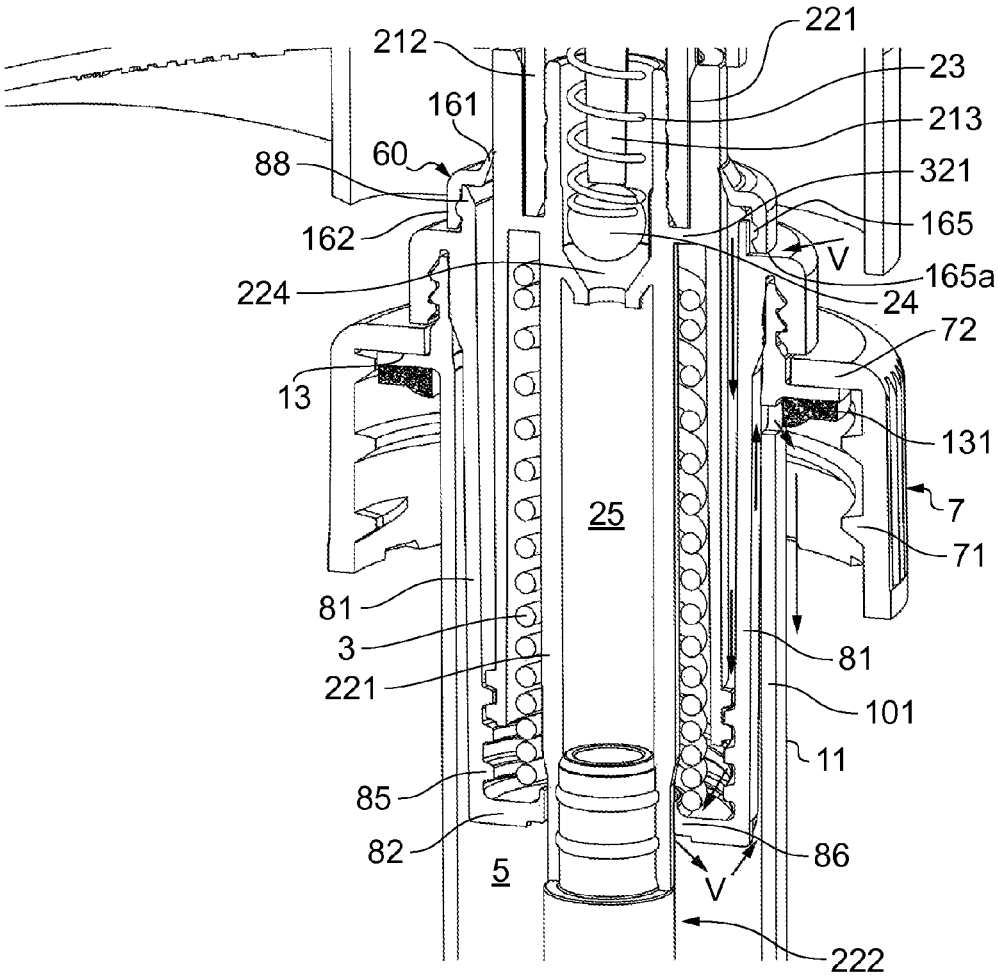
FIG. 2 is a partial perspective view of the FIG. 1 structure in enlarged detail, in full section, at the start of lock-down.
Figure 3:
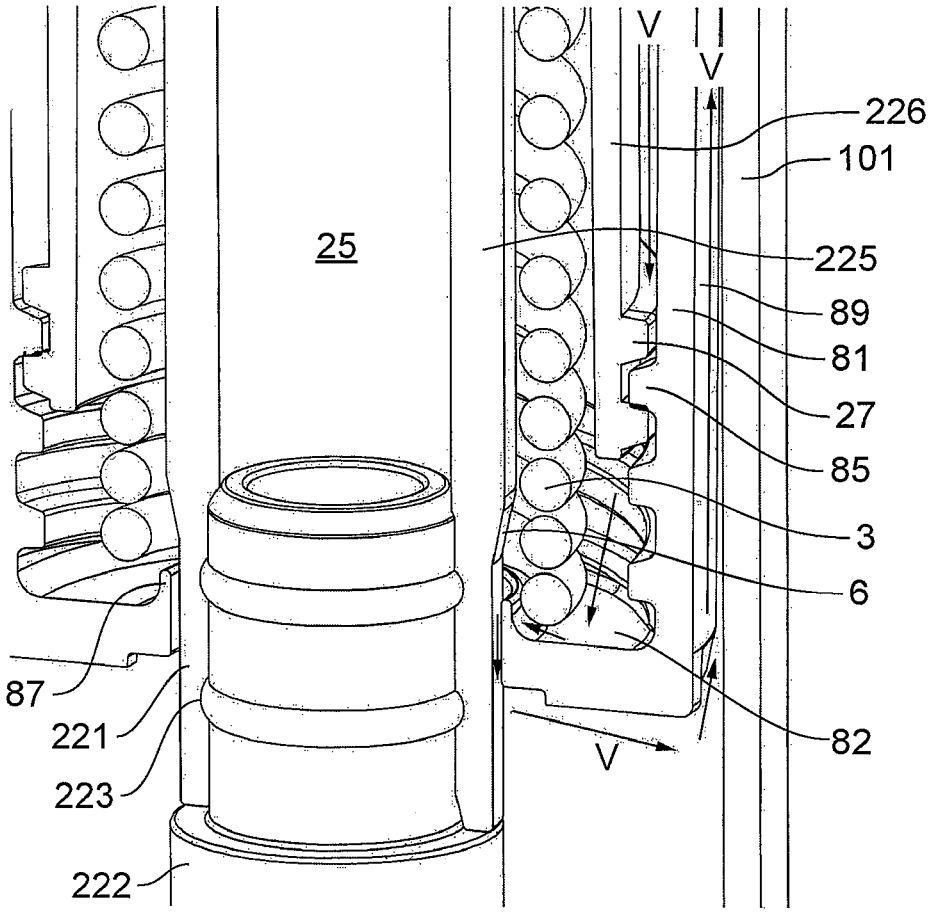
FIG. 3 is a partial perspective view of the FIG. 1 structure in enlarged detail, in full section, at the start of lock-down.

The collar insert 8 projects down inside the main body member 11 to define an enclosed cavity, and has a lower inward flange 82 providing a floor or reaction point for the foot of the pump spring 3. With reference also to FIGS. 2 and 3, the plunger stem 22 is formed from an upper stem part 221 and a lower stem part 222 snap-fitted together at an intermediate joint 223. The upper stem part 221 has a central tube 225 defining the outlet passage 25 and a long coaxial outer skirt 226 having lock-down thread formations 27 at its bottom end. The spring 3 fits in the annular clearance between the central tube 225 and the outer skirt 226. A top abutment 321 (FIG. 2) closes off this clearance to provide a top reaction point or spring seat of the plunger. Pump spring 3 is in compression so as to urge the plunger 2 towards the extended position seen in FIG. 1. FIGS. 2 and 3 show a compressed condition.

Referring to FIG. 2, the structures for mounting the pump body components together and onto the container are as follows. The retaining cap 7 has an internal screw thread 71 for engaging the container neck. A snap cap may be used instead. The cap has an inward flange 72 defining a circular opening through which the top of the body member 11 projects. The cap flange 72 engages the top surface of the outward body flange 13, beneath which a resilient seal member 131 is positioned, and compresses it sealingly against the top edge of the container neck (not shown).

Figure 5:
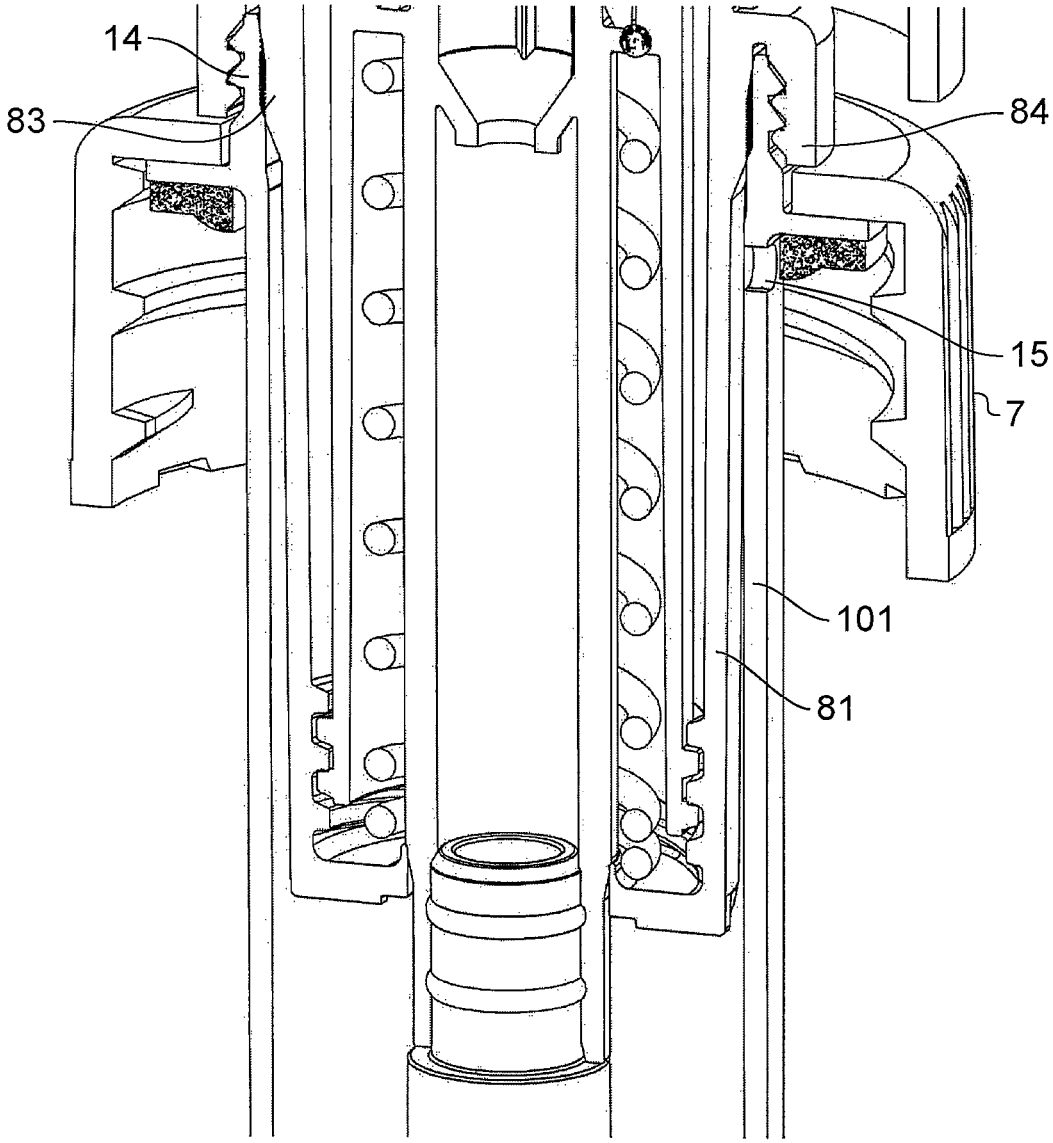
FIG. 5 is a partial perspective view of the FIG. 1 structure in enlarged detail, in full section, in a locked-down condition.

The top of the body member 11 has a tubular projection 14 with snap ribs (see also FIG. 5). The top of the collar insert 8 has an outer skirt 84 defining a corresponding annular slot with snap ribs, which snaps onto the top of the body member 11. The main tubular wall 81 of the collar insert 8 is slightly smaller in diameter than the main wall 101 of the body member 11, so that a narrow annular clearance 89 (see FIG. 3) is defined between them. However at its top the collar insert main wall has an outward thickening or plug portion 83 which fits closely and sealingly into the top of the body member 11.

The collar insert 8 has a top annular projection 88 with an external snap rib. A top outer seal member 60 (FIG. 2) fits onto this. The top outer seal member 60 has a mounting ring 162 which snaps around the top of the insert member 8, and an inwardly projecting sealing lip 161 which bears against the smooth cylindrical outer surface of the upper part 221 of the stem 22. The top outer seal guides the plunger movement, keeps external contaminants from the pump interior and, in the event of unexpected interior leakage, help to keep container contents from escaping to the exterior through the clearance between stem 22 and body insert 8.

A vent entrance notch 165 (see FIG. 2) is provided in the seal mounting projection 88, so that venting air can enter the clearance as indicated by the top arrow "V" in FIG. 2. The inlet 165*a* of the venting air passage at the lower edge of the seal member 60 begins at a radially outer surface of the seal member 60.

FIG. 2 also shows in detail the junction of the plunger head 21 and the plunger stem 22. The head has a downward tubular snap formation 212 which snaps into a complementary tubular snap socket 2211 at the top of the stem. A conical seat 224 for the outlet valve ball 24 is formed integrally with the upper stem 221. The valve ball 24 is urged resiliently against its seat by an outlet valve spring 23 held and guided by a spring guide projection 213 extending down from the top of the head (see FIG. 1). This spring holds the outward valve closed until a threshold pressure for discharge is reached.

Returning to the collar insert 8, at its bottom end, its interior has screw-thread lock-down formations 85 engageable with corresponding formations 27 at the bottom of the plunger stem skirt 226. In normal operation of the pump (direct depression of the plunger 2) these threads do not engage, but merely collide to define the bottom point of the plunger travel. FIGS. 2 and 3 show the onset of a lock-down operation in which the threads have been turned partly into engagement by turning the plunger.

Next, the venting path for air is described. This is air which must enter the container interior to compensate for the volume of product dispensed. The entrance notch 165 from the vent path has already been described (FIG. 2). As shown by arrows in FIGS. 2 and 3, this air can pass down inside the body insert 8 and outside the plunger 22 in the clearance between them. The lock-down threads 27 of the stem do not seal, and allow air to pass even when engaged. In normal operation they are in any case not engaged, passing up and down inside the tubular insert 8 with clearance as can be seen from FIG. 1 showing the plunger-up position.

At the bottom of the insert housing 8 the above-mentioned inward flange 82 forming the floor of the insert has a central opening through which the stem 22 passes, surrounded by a collar formation 86 which guides movement of the plunger stem and also provides sealing functions as will now be described.

Firstly, a down-position seal (for the locked-down condition) is provided as follows. See FIGS. 2 to 5. The central tube 225 of the upper stem 221 presents, near the join 223 with the lower stem, an upwardly divergent conical taper surface 6. For molding purposes, this is conveniently provided as a transition from a small-diameter to a large-diameter portion of the tube, although for functional purposes it could be a localized annular projection. The insert collar 86, at the top of its inner periphery, has an upwardly-directed lip portion 87 whose inner diameter is slightly less than the outer diameter of the stem taper face 6. When the pump is locked down, by engaging the lock-down threads 27,85 and turning from the FIG. 3 condition to the FIG. 5 condition, the stem taper face 6 enters the collar and slides into compressive engagement with the collar lip 87 which then acts a sealing lip (see FIG. 4), sealing between stem and body insert 8.

Figure 4:
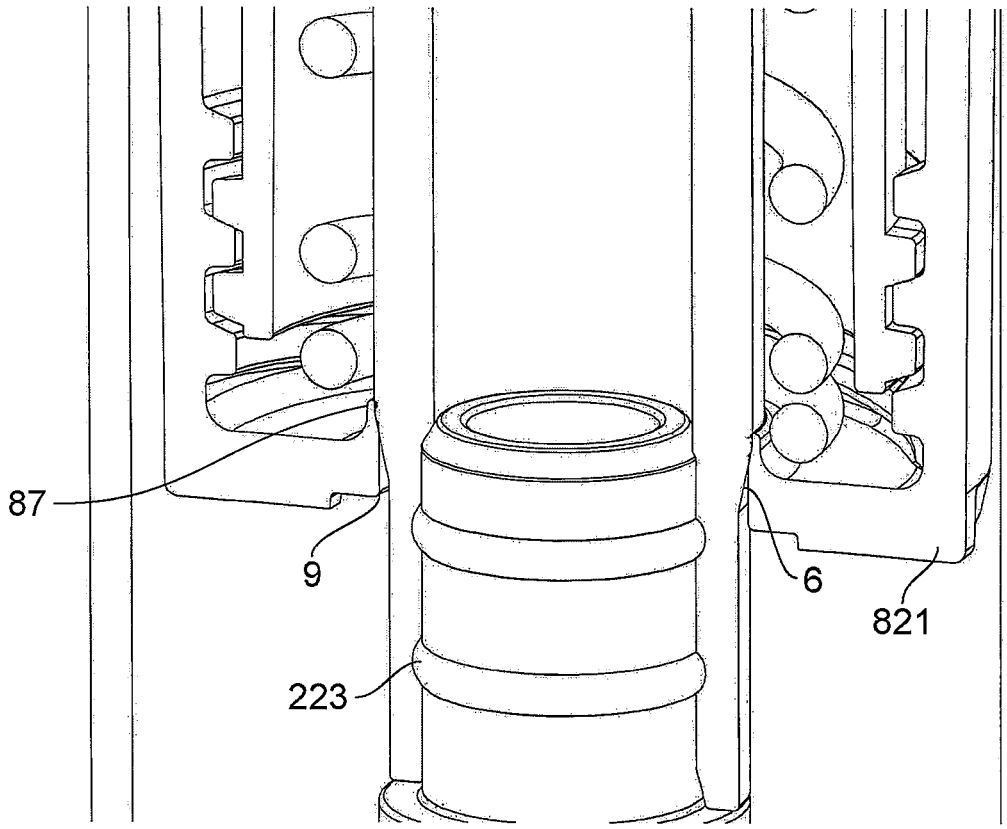
FIG. 4 is a partial perspective view of the FIG. 1 structure in enlarged detail, in full section, in a locked-down condition.

With reference to the venting function, FIG. 3 and FIG. 1 show how in all positions of the plunger 2 other than the locked-down position there is clearance between the collar 86 and the surface of the stem 22. This clearance allows venting air, as shown by the arrows in FIG. 3, to pass from the interior of the body insert 8 into the space above the piston 227 in the cylinder member 11, and outwardly to the clearance 89 between the body insert 8 and the body member wall 101. As shown in FIGS. 2 and 5, the body member wall has a vent opening 15 near its top, just beneath the retaining flange 13, allowing air to enter the container space from the clearance between the insert 8 and body wall 11. This completes the vent path V. [Note: the outer bottom edge of the insert 8 is tapered. The angled corner parts 821 seen in FIG. 4 are local lugs for machine engagement and relevant only for the assembly process.]

Thus, in the locked-down condition, engagement of the stem downward taper face 6 and the collar sealing lip 87 blocks the vent path and prevents product from escaping to the exterior via the vent path. At the same time, an extension 229 on the front of the piston (see FIG. 6) enters the inlet valve structure 16 to hold the inlet valve shut.

Figure 6:
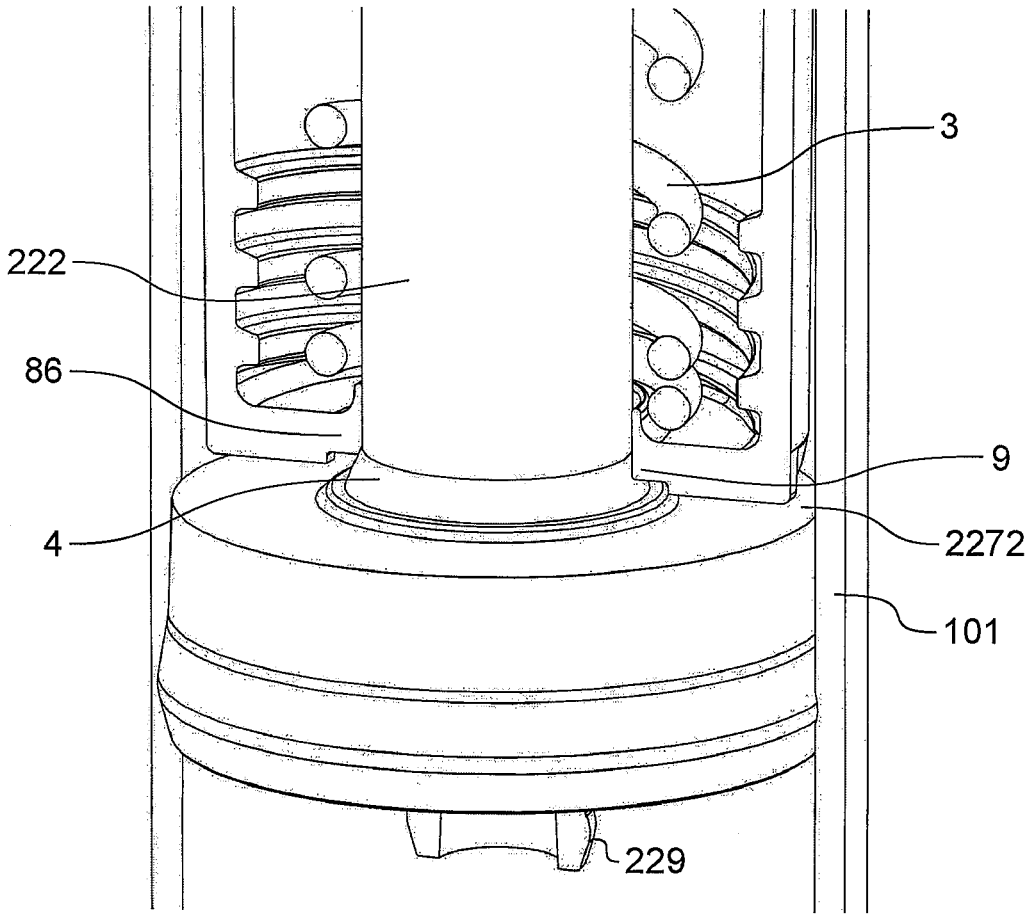
FIG. 6 is a partial perspective view of the FIG. 1 structure, focusing on vent path sealing according to one embodiment.

Next, up-position sealing is described. This is a particularly characteristic feature. Refer to FIGS. 1 and 6 showing the plunger in the raised (extended) position. Beneath the joint 223, the lower stem 222 has a uniform outer diameter until near the upper surface 2272 of the piston 227, where it has a conical divergence or outward taper surface 4 which constitutes a sealing portion for the "up" position. The collar 86 of the body insert 8 presents an angular edge corner 9 which meets a mid-region of the taper face 4 as shown in FIG. 6. To be clear, this engagement between annular corner edge 9 and the stem seal face 4 is the engagement that limits the rise of the plunger. In FIG. 6 the top face 2272 of the piston is not contacting the underside of the insert housing 8. Therefore the rising force of the pump spring 3 is brought to bear on the line of engagement between the annular corner 9 and the taper surface 4. Because of the taper, the engagement is accurately guided to a centered relation, with the spring force evenly distributed around the contact. Because of the narrow contact at the corner 9, there may also be limited deformation of the collar edge to improve the sealing fit.

This contact closes the vent passage in the up-position of the plunger, just as the previously-described seal does in the locked-down position of the plunger. It therefore inhibits escape of product from the dispenser through the vent passage in case the container is shaken, temporarily inverted or falls on its side. This is particularly important when the product is (or contains) low-viscosity or volatile organic liquids such as alcohols.

Figure 7:
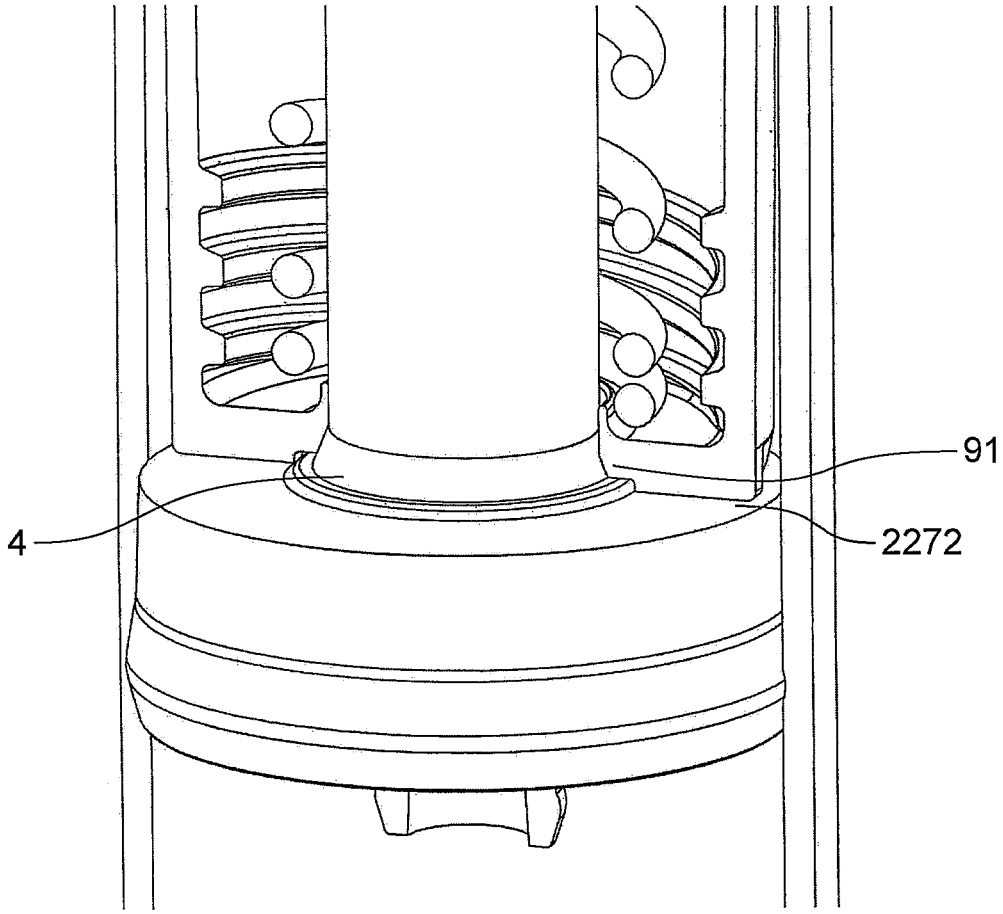
FIG. 7 is a partial perspective view of the FIG. 1 structure, focusing on vent path sealing according to an alternate embodiment.

The skilled reader will appreciate that the conformation of the complementary stem and collar seal portions 4,9 for the up-position seal may be devised according to the degree of sealing required. For example, this seal may, like the lock-down seal, entail a flexible sealing lip portion on the collar. The angle of the taper can be determined in dependence on the deformability of the materials and the fluid-tightness of the seal required. The smaller the angle of divergence from the axis, the tighter the achievable seal with a given spring pump force. Typically, the divergence will be at least 20 degrees from the plunger axis, usually less than 70 degrees. It is possible to provide the taper surface (downwardly-directed) on the collar 86, and have the corner on the plunger stem. Or, as shown in the variant construction of FIG. 7, both components may be provided with taper surfaces 4,91 with complementary angles. In this embodiment the upward piston surface and the downward surface of the collar insert 8 are shaped complementarily, so that the stop contact and the potential sealing surface extend out across the piston.

Figure 8:
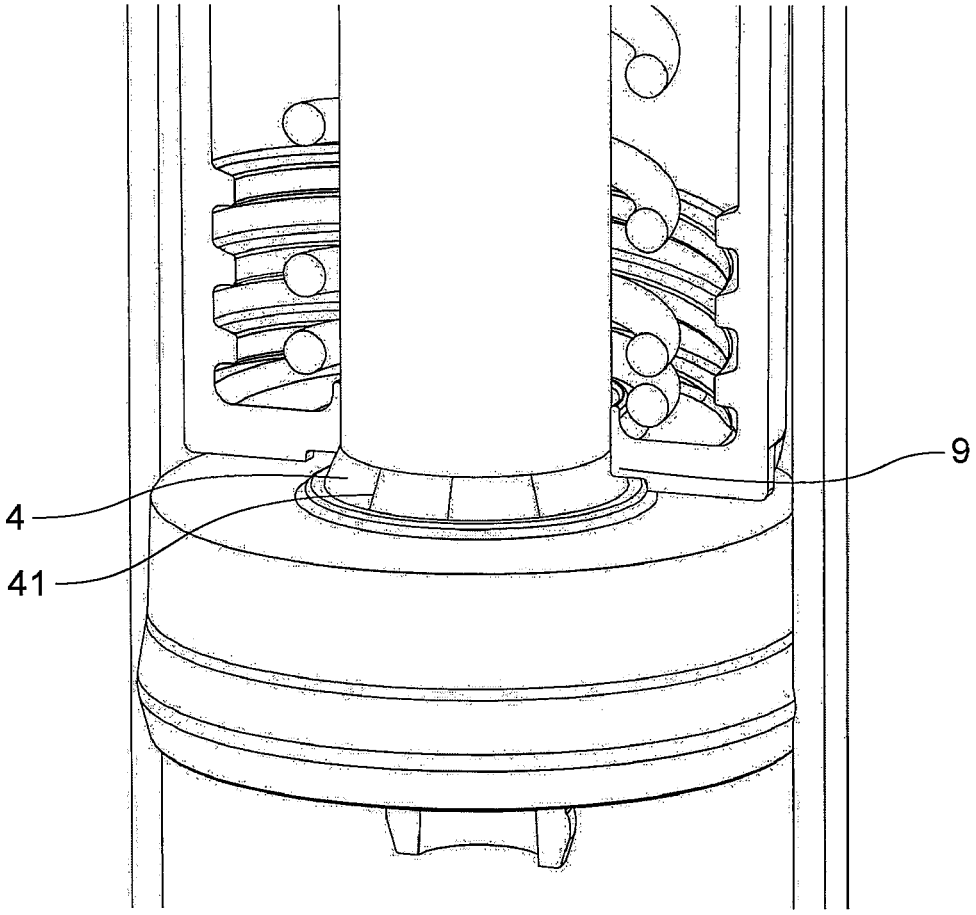
FIG. 8 is a partial perspective view of the FIG. 1 structure, focusing on vent path sealing according to an alternate embodiment.

FIG. 8 shows a further refinement or variant which is found useful with products containing highly volatile components, for situations where there is a concern that a dangerously high pressure might build up in the pump. In this abnormal situation some controlled venting of gas pressure via the vent path may be desirable to prevent the alternative of venting through the outlet valve which would tend to eject liquid product from the nozzle. However it is still desirable to avoid the escape of liquid via the vent path, as mentioned. To this end, we find that useful results can be achieved by interrupting the tapered sealing surface described with one or more localized slots, grooves or notches. FIG. 8 shows this variant (based on the FIG. 6 construction) with plural narrow notches 41 formed up the stem taper surface 4. It will be understood that these notches could additionally or alternatively be formed in the sealing portion 9 of the collar.

Figure 9:
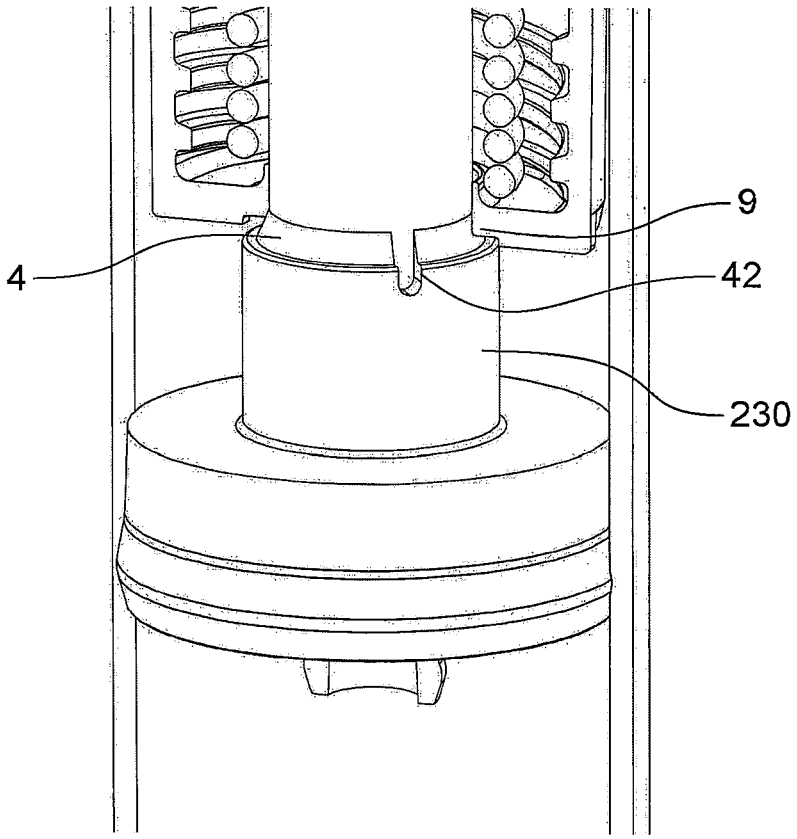
FIG. 9 is a partial perspective view of the FIG. 1 structure, focusing on vent path sealing according to an alternate embodiment.

FIG. 9 shows a further variant for allowing the venting of internal gas pressure when the contents are of a higher viscosity or gel nature. A larger predetermined notch size for gas venting is arranged by thickening the stem wall material 230 beneath the sealing taper 4 and above the piston, so that the vent notch 42 will have a larger area. Because the envisaged product has a higher viscosity or higher surface tension, such as a gel or paste, it can be assured (if necessary by routine tests) that liquid product will not pass through the gas vent notch 42.

While the preferred embodiment of the invention has been illustrated and described in the drawings and foregoing description, the same is to be considered as illustrative and not restrictive in character, it being understood that all changes and modifications that come within the spirit of the invention are desired to be protected.

The invention claimed is:

1. A dispenser pump for dispensing product from a container, said dispenser pump comprising:
- a pump body including a cylinder member, a collar insert assembled to said cylinder member and a retainer cap captured by combination of said collar insert and said cylinder member;
- a plunger received within said pump body, said plunger having an inner tubular portion and an outer wall;
- a seal member assembled to said collar insert and contacting said outer wall; and
- an air vent passage constructed and arranged for supplying make up air to said container, wherein said air vent passage includes an inlet defined by said seal member and said collar insert.

2. The dispenser pump of claim 1 wherein said air vent passage includes an outlet defined by said cylinder member.

3. The dispenser pump of claim 2 wherein said air vent passage includes a first portion which extends between said outer wall and said collar insert and a second portion which extends between said collar insert and said cylinder member.

4. A dispenser pump for dispensing product from a container, said dispenser pump comprising:
- a pump body including a cylinder member, a collar insert assembled to said cylinder member and a retainer cap captured by combination of said collar insert and said cylinder member;
- a plunger received within said pump body, said plunger having an inner tubular portion and an outer wall;
- a seal member assembled to said collar insert and contacting said outer wall; and
- an air vent passage constructed and arranged for supplying make up air to said container, wherein said collar insert includes a formation portion for plunger lock down, said outer wall including a cooperating formation portion, wherein when said plunger is in a locked-down condition, a portion of said air vent passage extends between the formation portion of said collar insert and the formation portion of said outer wall and is closed off by a sealed interface between inner tubular portion and said collar insert.

5. A dispenser pump for dispensing product from a container, said dispenser pump comprising:
- a pump body including a cylinder member, a collar insert assembled to said cylinder member and a retainer cap captured by combination of said collar insert and said cylinder member;
- a plunger received within said pump body, said plunger having an inner tubular portion and an outer wall;
- a seal member assembled to said collar insert and contacting said outer wall; and
- an air vent passage constructed and arranged for supplying make up air to said container, wherein said collar insert includes a seal portion and said inner tubular portion includes a cooperating seal portion for sealing off said air vent passage when said plunger is in an extended position.

6. A dispenser pump for dispensing product from a container, said dispenser pump comprising:

a pump body including a cylinder member, a collar insert assembled to said cylinder member and a retainer cap captured between combination of said collar insert and said cylinder member;

a plunger received within said pump body, said plunger having an inner tubular portion and an outer wall;

an air vent passage between said inner tubular portion and said collar insert constructed and arranged for supplying make up air to said container; and wherein said collar insert includes a seal portion and said inner tubular portion includes a cooperating seal portion for sealing off said air vent passage when said plunger is in an extended position.

7. The dispenser pump of claim 6 wherein when said plunger is in a locked-down condition, a sealed interface is established by engagement between said inner tubular portion and said collar insert.

8. The dispenser pump of claim 7 wherein said sealed interface is established between the seal portion of said collar insert and a tapered surface of said inner tubular portion.

9. The dispenser pump of claim 6 which further includes a gas vent notch defined by a stem wall of said plunger and cooperating with said air vent passage.

10. The dispenser pump of claim 9 wherein said gas vent notch has a size which is dependent in part on product viscosity.

11. The dispenser pump of claim 6 which further includes a seal member assembled to said collar insert and contacting said outer wall.

12. A dispenser pump for dispensing product from a container, the dispenser pump comprising a pump body having a pump cylinder portion;

a plunger which has a head, a stem and a piston, the plunger being reciprocable relative to the pump body;

a pump outlet structure providing a discharge passage extending from a pump chamber to a discharge opening of the pump;

an air vent path for admitting make-up air into said container, said vent path being defined through said pump from a vent inlet through a clearance between the plunger stem and pump body to a vent outlet defined by a cylinder wall of said pump body;

said pump body comprising a collar portion and the vent path leading through a vent gap defined between the collar portion and the stem of the plunger;

the collar portion includes a seal portion and the plunger stem includes a cooperating seal portion for sealing off said vent path when said plunger is in an extended position; and the pump body comprising a cylinder body member and an insert housing, the cylinder body member having a lower portion defining said pump chamber and the insert housing being tubular with a generally cylindrical side wall, the plunger stem being inside the insert housing with clearance between them, the tubular insert housing having a floor with a central opening through which the plunger stem passes and which comprises said collar portion and collar seal portion, part of said vent path before said vent gap being provided by said clearance between the plunger stem and the insert housing and part of said vent path after said vent gap being provided by clearance between the outside of the insert housing and the inside of the wall of the cylinder body member.

13. A dispenser pump according to claim 12 in which one or both of the plunger stem seal portion and the collar seal portion are tapered to guide said seal portions into fitting engagement with one another.

14. A dispenser pump according to claim 13 in which one of the plunger stem seal portion and the collar seal portion has a taper surface and the other of the plunger stem seal portion and the collar seal portion has a corner edge which meets a mid-region of said taper surface to make the sealing engagement as a line of engagement.

15. A dispenser pump according to claim 13 in which each of the plunger stem seal portion and the collar seal portion has a respective taper surface.

16. A dispenser pump according to claim 12 in which both the plunger stem seal portion and the collar seal portion are annular.

17. A dispenser pump according to claim 12 in which the plunger stem seal portion is formed as a taper on the plunger stem.

18. A dispenser pump according to claim 12 in which the plunger stem seal portion is formed as a taper at a transition from the stem to the piston.

19. A dispenser pump according to claim 12 in which said clearance between the outside of the insert housing and the inside of the wall of the cylinder body member, providing a part of said vent path after said vent gap, is an annular clearance.

20. A dispenser pump according to claim 12 comprising respective lock-down formations on the pump body and plunger which can be engaged with one another to hold the plunger in the retracted position relative to the body.

21. A dispenser pump according to claim 12 in which the tubular insert housing projects down inside the cylinder body member below the vent outlet defined by the cylinder wall.

22. A dispenser pump according to claim 12 in which the discharge passage has an outlet valve, and the outlet valve comprises a valve member, a valve seat and a spring urging the valve member against the valve seat.

23. A dispenser pump according to claim 12 in which the pump is a movable-nozzle pump having the discharge channel and discharge opening comprised in the plunger, and comprises a pump spring urging the plunger towards the extended position relative to the pump body a lower end of the insert housing providing a support for a lower end of said pump spring.

24. A dispenser pump according to claim 12 in which one or both of said plunger seal portion and collar seal portion has a slot or groove to allow gas venting past the vent path seal.

25. A dispenser pump for dispensing product from a container, the dispenser pump comprising a pump body having a pump cylinder portion;

a plunger which has a head, a stem and a piston, the plunger being reciprocable relative to the pump body;

a pump outlet structure providing a discharge passage extending from a pump chamber to a discharge opening of the pump;

an air vent path for admitting make-up air into said container, said vent path being defined through said pump from a vent inlet through a clearance between the plunger stem and pump body to a vent outlet defined by a cylinder wall of said pump body;

said pump body comprising a collar portion and the vent path leading through a vent gap defined between the collar portion and the stem of the plunger;

the collar portion includes a seal portion and the plunger stem includes a cooperating seal portion for sealing off said vent path when said plunger is in an extended position;

the pump body comprising a cylinder body member and an insert housing, the cylinder body member having a lower portion defining said pump chamber and the insert housing being tubular, with the plunger stem inside the insert housing and with clearance between them, the insert housing having a floor with a central opening through which the plunger stem passes and which comprises said collar portion and collar seal portion, part of said vent path before said vent gap being provided by said clearance between the plunger stem and the insert housing; and the dispenser pump further comprising respective lock-down formations on the pump body and plunger which can be engaged with one another to hold the plunger in the retracted position relative to the body, and in which the plunger stem has a downwardly-directed seal element and the pump body has a corresponding upwardly-directed seal element which seal elements co-operate to block the vent path in the retracted position of the plunger relative to the body.

26. A dispenser pump according to claim 25 in which the upwardly-directed seal element of the pump body is on said collar portion of the insert housing.

27. The dispenser pump of claim 25 which further includes a seal member assembled to said collar portion and contacting said plunger.

28. A dispenser pump for dispensing product from a container, the dispenser pump comprising a pump body which has a top opening and comprises a pump cylinder portion defining a pump chamber and an inlet to the pump chamber, said pump body including a collar insert;

a plunger which has a head, a stem and a piston, the piston being at a lower end of the stem and in said pump chamber;

a pump outlet structure providing a discharge channel extending from the pump chamber to a discharge opening of the pump;

the structure of said pump also defining a vent path for admitting air into a said container to compensate for the volume of product dispensed in use, said vent path being defined through said pump from an exterior vent opening, where air is admitted, to a clearance between the collar insert and pump body outside the pump chamber, and thence to an interior vent opening, said interior vent opening being defined through or around an edge of a cylinder wall of said pump body to lead to the interior of said container;

the dispenser pump further comprising respective lock-down formations on the pump body and plunger which can be engaged with one another to hold the plunger in the retracted position relative to the body, and the pump body has a seal member around the top opening thereof, said seal member acting against the outer surface of the plunger stem.

29. A dispenser pump according to claim 28 in which the pump body comprises a cylinder body member, the cylinder body member having a lower portion defining said pump chamber and the insert housing being tubular and projecting down inside the cylinder body member so as to occupy an upper portion thereof.

30. A dispenser pump according to claim 29 in which the pump is a movable-nozzle pump having the discharge channel and discharge opening comprised in the plunger, and comprises a pump spring urging the plunger towards the extended position relative to the pump body.

31. A dispenser pump for dispensing product from a container, said dispenser pump comprising:

a pump body including a cylinder member, a collar insert assembled to said cylinder member and a retainer cap captured by combination of said collar insert and said cylinder member;

a plunger received within said pump body, said plunger having an inner tubular portion and an outer wall;

a seal member assembled to said collar insert and contacting said outer wall; and an air vent passage constructed and arranged for supplying make up air to said container, wherein said air vent passage includes an inlet which is defined by said collar insert and said seal member, wherein said inlet begins at the radially outer surface of said seal member.

32. A dispenser pump for dispensing product from a container, said dispenser pump comprising:

a pump body including a cylinder member, a collar insert assembled to said cylinder member and a retainer cap captured by combination of said collar insert and said cylinder member;

a plunger received within said pump body, said plunger having an inner tubular portion and an outer wall;

a seal member assembled to said collar insert and contacting said outer wall;

an air vent passage constructed and arranged for supplying make up air to said container; and a spring positioned between said inner tubular portion and said outer wall, wherein said spring is isolated from contact with said product.

33. A dispenser pump for dispensing product from a container, said dispenser pump comprising:

a pump body including a cylinder member, a collar insert assembled to said cylinder member and a retainer cap captured by combination of said collar insert and said cylinder member;

a plunger received within said pump body, said plunger having an inner tubular portion and an outer wall;

a seal member assembled to said collar insert and contacting said outer wall; and an air vent passage constructed and arranged for supplying make up air to said container, wherein when said plunger is in a locked-down condition, a sealed interface is established by engagement between said inner tubular portion and said collar insert.

34. A dispenser pump for dispensing product from a container, said dispenser pump comprising:

a pump body including a collar insert;

a plunger received within said pump body, said plunger including a plunger stem with a stem wall, said plunger being constructed and arranged for reciprocating movement within said pump body;

a vent passage defined between said collar insert and said plunger for venting of internal gas; and a gas vent notch defined by said stem wall and cooperating with said vent passage.

35. The dispenser pump of claim 34 wherein said gas vent notch has a size which is dependent in part on product viscosity.

* * * * *